US008878755B2

(12) United States Patent
Chang et al.

(10) Patent No.: US 8,878,755 B2
(45) Date of Patent: Nov. 4, 2014

(54) ORGANIC LIGHT-EMITTING DIODE DISPLAY AND METHOD OF DRIVING SAME

(75) Inventors: Hua-Gang Chang, Hsinchu (TW); Tsung-Ting Tsai, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 210 days.

(21) Appl. No.: 13/593,252

(22) Filed: Aug. 23, 2012

(65) Prior Publication Data

US 2014/0055434 A1 Feb. 27, 2014

(51) Int. Cl.
*G09G 3/30* (2006.01)

(52) U.S. Cl.
USPC ..... 345/78; 345/76; 345/208; 315/169.3

(58) Field of Classification Search
USPC ..... 345/76–83, 204–214, 690–699; 315/169.3
See application file for complete search history.

(56) References Cited

U.S. PATENT DOCUMENTS

| | | | | |
|---|---|---|---|---|
| 7,327,357 | B2 | 2/2008 | Jeong | |
| 2009/0278771 | A1* | 11/2009 | Yamamoto et al. | 345/76 |
| 2010/0103081 | A1* | 4/2010 | Takasugi et al. | 345/45 |
| 2011/0109531 | A1* | 5/2011 | Choi | 345/76 |
| 2011/0193855 | A1* | 8/2011 | Han | 345/214 |
| 2011/0227956 | A1 | 9/2011 | Park et al. | |
| 2013/0222356 | A1* | 8/2013 | Jeong et al. | 345/211 |

* cited by examiner

*Primary Examiner* — Dmitriy Bolotin
(74) *Attorney, Agent, or Firm* — Tim Tingkang Xia, Esq.; Morris Manning & Martin, LLP

(57) ABSTRACT

In one aspect of the invention, a method of driving an OLED display includes providing scan signals and data signals and applying the scan signals to scan lines and the data signals to the data lines, respectively. Each scan signal is characterized with a waveform having a compensation duration and a scan duration immediately following the compensation duration. The waveform has a first voltage and a second voltage periodically and alternately varied from one another defining a period in the compensation duration, and has the first voltage in the scan duration. The period is equal to the scan duration but shorter than the compensation duration. As such, during the compensation duration of a scan signal, pixels of a corresponding pixel row are charged for compensation, and during the scan duration, the data signals are written into the pixels of the corresponding pixel row for driving the OLEDs thereof.

9 Claims, 10 Drawing Sheets

ORGANIC LIGHT-EMITTING DIODE DISPLAY AND METHOD OF DRIVING SAME

FIELD OF THE INVENTION

The present invention generally relates to organic light-emitting diode (OLED) display technology, and more particularly to an OLED display that utilizes multi-scanning for compensation and methods of driving the same.

BACKGROUND OF THE INVENTION

With the developments and applications of electronic products, there has been increasing demand for flat panel displays that consume less electric power and occupy less space. Among flat panel displays, organic light-emitting diode (OLED) displays are self-emitting, and highly luminous, with wider viewing angles, faster responses, and simple fabrication processes, making them the industry display of choice.

OLED displays are usually categorized into passive matrix OLED (PMOLED) displays and active matrix OLED (AMOLED) displays. The AMOLED display employs TFTs (thin film transistors) and storage capacitors to control the brightness and grayscale of the OLED display.

Generally, for an AMOLED display, compensation is required to ensure the stable performance of the luminance and color of the display. An AMOLED display usually has scan lines, data lines, and a pixel array connected to the scan lines and the data lines with each pixel having an OLED, and one or more compensation circuits connected to each pixel. In operation, a plurality of scan signals is provided sequentially to the scan lines such that, within a scan duration of the scan signals, a data signal transmitted to one of the pixels through the corresponding data line is written to the pixel, and compensation is also performed with the compensation circuits within the same scan duration in which the data is written to the pixel. Referring to FIG. 5, three of the scan signals, S(n−1), S(n) and S(n+1), and one of the data signal, D(k), are illustrated. Each of the scan signals S(n−1), S(n) and S(n+1) has a pulse with a pulse width defining the scan duration Ts. The data signal D(k) includes a stream of data pulses including $D_{n-1}$, $D_n$, $D_{n+1}$, . . . to be written to the pixels of different pixel rows in response to the scan signals S(n−1), S(n) and S(n+1), . . . , respectively. The stream of data pulses defines a period τ that is the same as the scan duration Ts. As shown in FIG. 5, within the scan duration Ts, the compensation with a compensation duration $T_C$ and the gate scan with a scan time $T_g$ are performed.

Due to the requirement of high resolution and high frame rate of the display, the scan duration Ts is greatly reduced. For example, for a 120 Hz full-high-definition (FHD) OLED display, the average scan duration Ts is about 7.7 μs. The higher the resolution and the frame rate, the shorter the scan duration Ts. A shorter scan duration Ts requires a shorter compensation duration Tc for the compensation procedure. However, if the scan duration Ts becomes too short, it may be insufficient for the compensation procedure.

Therefore, a heretofore unaddressed need exists in the art to address the aforementioned deficiencies and inadequacies.

SUMMARY OF THE INVENTION

The present invention, in one aspect, relates to a method of driving an organic light emitting diode (OLED) display. The OLED display has a plurality of scan lines and a plurality of data lines crossing over the plurality of scan lines to define a plurality of pixels in a matrix form, each pixel electrically connected to a corresponding scan line and a corresponding data line and having an OLED. In one embodiment, the method includes providing a plurality of scan signals and a plurality of data signals, applying the plurality of scan signals sequentially to the plurality of scan lines and the plurality of data signals simultaneously to the plurality of data lines, respectively. The plurality of data signals is associated with an image to be displayed. Each scan signal is characterized with a waveform having a compensation duration $T_C$ and a scan duration $T_S$ immediately following the compensation duration. The waveform in the compensation duration $T_C$ has a first voltage level and a second voltage level periodically and alternately varied from one another defining a period τ, and the waveform in the scan duration $T_S$ has the first voltage level. The period τ is equal to the scan duration $T_S$ but shorter than the compensation duration $T_C$. As such, during the compensation duration $T_C$ of a scan signal, the pixel circuits of a corresponding pixel row connected to the scan line to which the scan signal is applied are charged for compensation, while during the scan duration $T_S$ of the scan signal, the plurality of data signals is written into the pixels of the corresponding pixel row for driving the OLEDs thereof.

In another aspect of the present invention, an OLED display includes: a plurality of scan lines and a plurality of data lines crossing over the plurality of scan lines to define a plurality of pixels in a matrix form, each pixel electrically connected to a corresponding scan line and a corresponding data line and having an OLED, a scan driver electrically connected to the plurality of scan lines and configured to provide a plurality of scan signals, and a data driver electrically connected to the plurality of data lines and configured to provide a plurality of data signals associated with an image to be displayed.

Each scan signal is characterized with a waveform having a compensation duration $T_C$ and a scan duration $T_S$ immediately following the compensation duration $T_C$. The waveform in the compensation duration $T_C$ has a first voltage level and a second voltage level periodically and alternately varied from one another defining a period τ, which is equal to the scan duration $T_S$ but shorter than the compensation duration $T_C$ The waveform in the scan duration $T_S$ has the first voltage level. In operation, the scan driver sequentially applies the plurality of scan signals to the plurality of scan lines and the data driver simultaneously applies the plurality of data signals to the plurality of data lines, respectively, such that during the compensation duration $T_C$ of a scan signal, the pixels of a corresponding pixel row connected to the scan line to which the scan signal is applied are charged, while during the scan duration $T_S$ of the scan signal, the plurality of data signals is written into the pixels of the corresponding pixel row for driving the OLEDs thereof.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
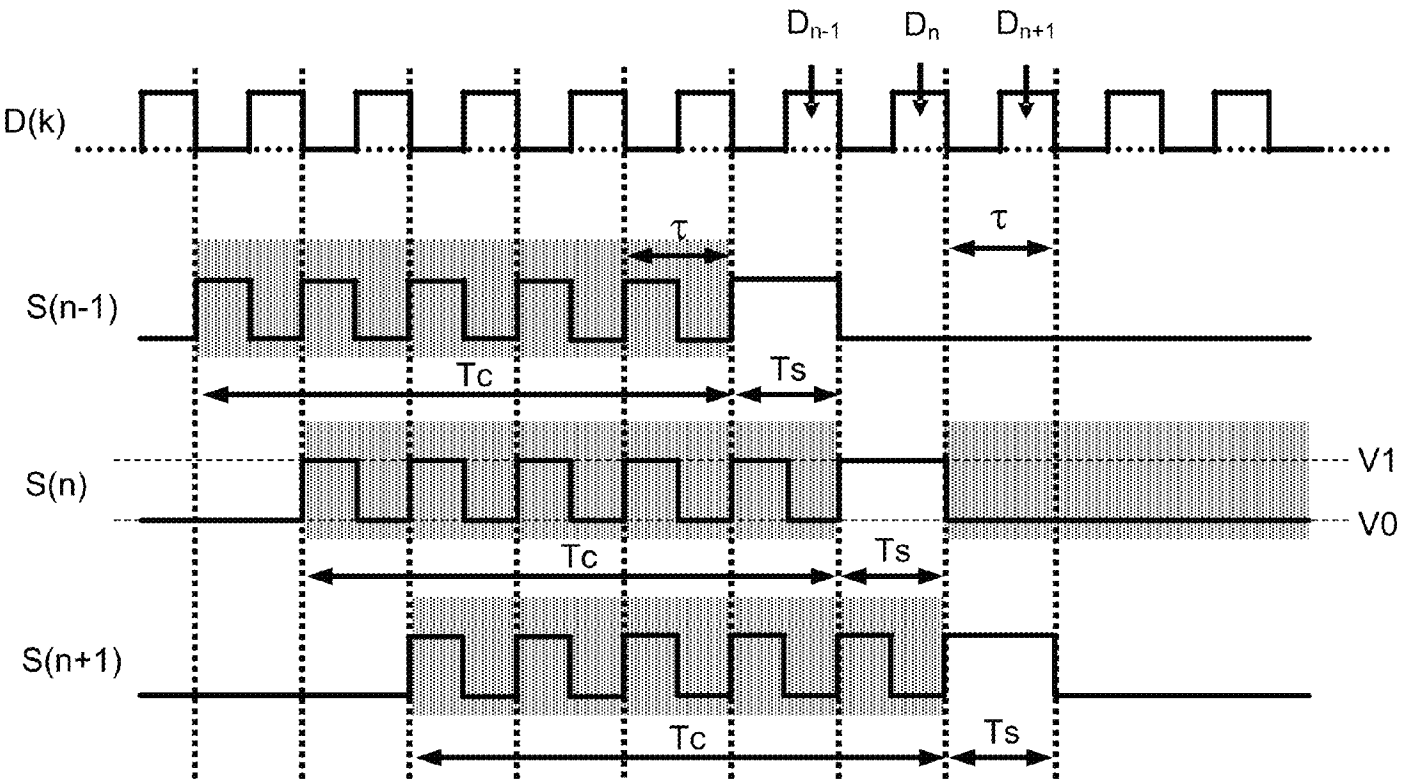
FIG. 1 shows schematically waveforms of driving signals for an OLED display according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the present invention in conjunction with the accompanying drawings in FIGS. 1-4B. In accordance with the purposes of this invention, as embodied and broadly described herein, this invention, in one aspect, relates to an OLED display and a method of driving the same.

Referring to FIG. 1, waveforms of scan and data signals for driving an OLED display are schematically shown according to one embodiment of the present invention. The OLED display has a plurality of scan lines and a plurality of data lines crossing over the plurality of scan lines to define a plurality of pixels in a matrix form. Each pixel is electrically connected to a corresponding scan line and a corresponding data line and has an OLED. For driving such the OLED display, a plurality of scan signals and a plurality of data signals are provided to the plurality of scan lines and the plurality of data lines, respectively. The plurality of data signals is associated with an image to be displayed. The plurality of scan signals is configured to sequentially turn on the pixel rows, so that the data signals can be input or written to the corresponding pixel TOWS.

As shown in FIG. 1, one data signal D(k) and three scan signals S(n−1), S(n) and S(n+1) are provided for illustration of the method of multi-scan compensation for the OLED display, where k, n are positive integers. The data signal D(k) includes a stream of data pulses including $D_{n-1}$, $D_n$, $D_{n+1}$, . . . to be written to the pixels of different pixel rows corresponding scan signals S(n−1), S(n) and S(n+1), . . . , respectively. Each scan signal is characterized with a waveform having a compensation duration $T_C$ and a scan duration $T_S$ immediately following the compensation duration $T_C$. In one embodiment, the waveform of each scan signal in the compensation duration $T_C$ has a first voltage level and a second voltage level (such as the high voltage level V1 and the low voltage level V0 as shown in FIG. 1) periodically and alternately varied from one another defining a period $\tau$, and the waveform of each scan signal in the scan duration $T_S$ has the first voltage level (such as the high voltage level V1). In one embodiment, the period $\tau$ is equal to or shorter than the scan duration $T_S$. As shown in FIG. 1, the period $\tau$ is equal to the scan duration $T_S$, and is shorter than the compensation duration $T_C$. In the exemplary embodiment shown in FIG. 1, the compensation duration $T_C$ is exactly five times of the scan duration $T_S$. In one embodiment, the compensation duration $T_C$ can be N times of the scan duration $T_S$, where N can be any positive integer.

In the exemplary embodiment shown in FIG. 1, the data signal D(k) is also characterized with a waveform has a phase that is opposite to that of the waveform of the scan signals in the compensation duration $T_C$. In other words, the waveform of the data signal D(k) has a low voltage level and a high voltage level periodically and alternately varied from one another defining the same period $\tau$ with the scan signals.

When the OLED display is in operation, the plurality of scan signals is applied sequentially to the plurality of scan lines, and the plurality of data signals is applied simultaneously to the plurality of data lines, respectively. As such, during the compensation duration $T_C$ of a scan signal, for example, S(n), the pixels of a corresponding pixel row connected to the scan line to which the scan signal is applied are charged. Further, during the scan duration $T_S$ of the scan signal S(n), the plurality of data signals is written into the pixels of the corresponding pixel row for driving the OLEDs thereof. Since the compensation duration $T_C$ is longer than the scan duration $T_S$, the compensation procedure can be performed during the multiple periods $\tau$ prior to the scan duration $T_S$, during which the data signal $D_n$ is written to the pixel.

For example, when a scan signal S(n) is applied to the n-th pixel row, the data $D_n$ will be written into the n-th pixel in the n-th pixel row. As shown in FIG. 1, during the compensation duration $T_C$ of the scan signal S(n), which includes the five periods $\tau$ prior to the scan duration $T_S$, the pixel receives the data $D_{n-5}$ to $D_{n-1}$ through the data line. Since the waveform of the data signal D(k) is in the opposite phase to the waveform of the scan signals S(n) in the compensation duration $T_C$, the data $D_{n-5}$ to $D_{n-1}$ would not be written to the pixel; instead, capacitor(s) in the pixel are charged for compensation to the OLED. During the scan duration $T_S$ of the scan signal S(n), the scan signal S(n) has the high voltage level V1, and thus the data $D_n$ is written into the pixel.

It should be noted that, due to different pixel circuit configuration of the pixels of the OLED display, the voltage levels of the scan signal S(n) can be different. For example, FIG. 1 shows the first voltage level as a high voltage level V1, and the second voltage level as a low voltage level V0. In one embodiment, the first voltage level can be a low voltage level V0, and the second voltage level can be a high voltage level V1.

In one embodiment, to ensure that each pixel can be returned to its original state before the data signal is written to the pixel, a resetting step is performed before the compensation procedure by applying a reset signal to reset the pixels of the corresponding pixel row for a reset duration $T_R$ (not shown in FIG. 1) prior to the compensation duration $T_C$. The reset duration $T_R$ can be longer than the scan duration Ts, and can be M times of the scan duration $T_S$, where M is a positive integer.

Additionally, an emission signal is also applied to the pixels of the corresponding pixel row for an emission duration $T_E$ (not shown in FIG. 1) immediately following the scan duration $T_S$ such that the OLEDs of the pixels of the corresponding pixel row are driven to emit light according to the plurality of data signals written into the pixels.

The method of the present invention can be used in a variety of OLED displays with different pixel circuit structures, with different signals being provided to perform multi-scan compensation.

Figure 2A:
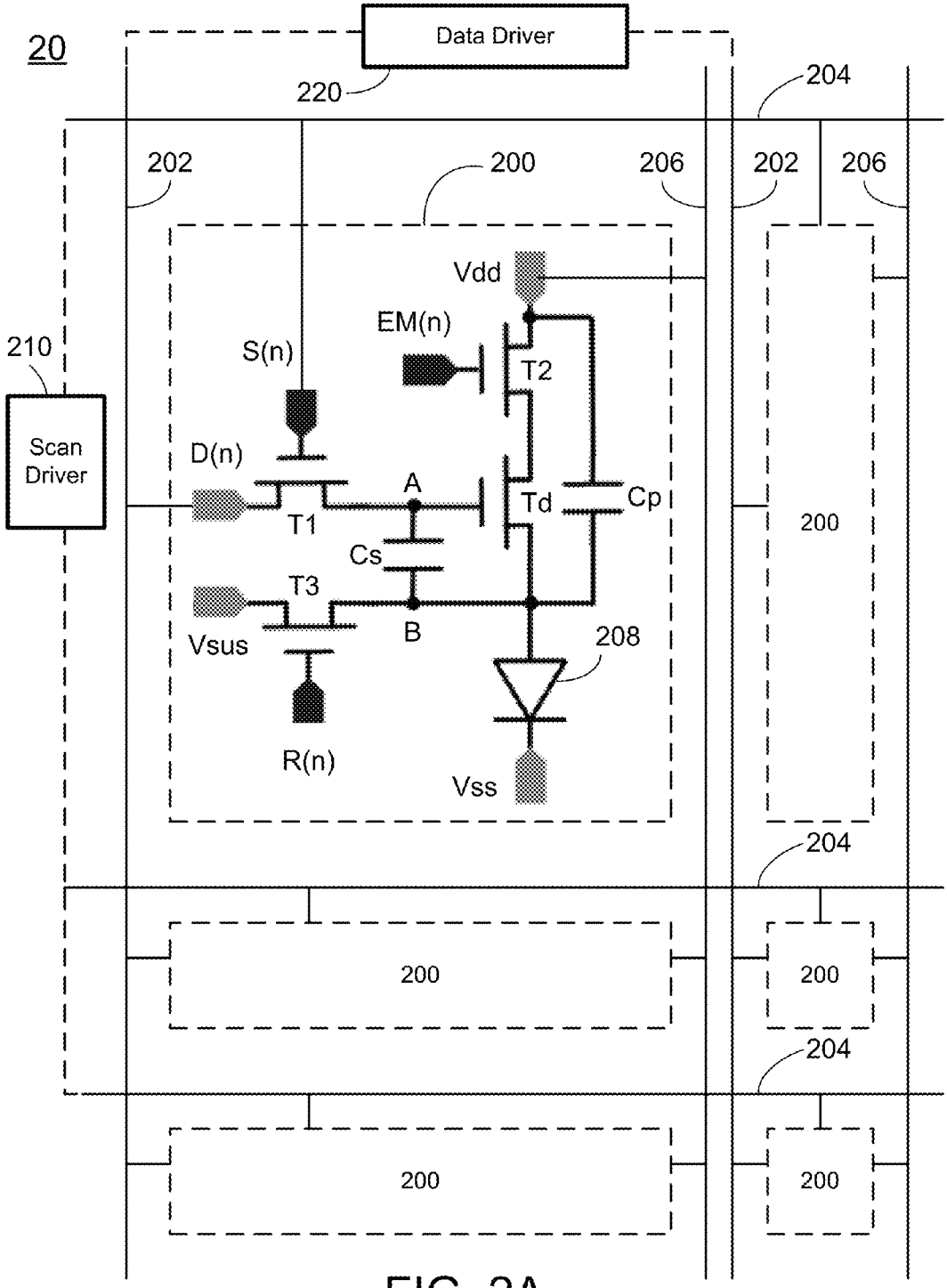
FIG. 2A shows schematically an OLED display and one of its pixels according to one embodiment of the present invention.

FIG. 2A shows schematically an OLED display and one of its pixels according to one embodiment of the present invention. The OLED display 20 has a plurality of data lines 202, a plurality of scan lines 204, a plurality of power lines 206, a scan driver 210, and a data driver 220. The plurality of data lines 202 crosses over the plurality of scan lines 204 to define a plurality of pixels 200 in a matrix form. Each pixel 200 is electrically connected to a corresponding scan line 204, a corresponding data line 202 and a corresponding power line 206, and has an OLED 208. For better illustration purposes, only one of the pixels 200 in FIG. 2A is shown with the detailed circuit structure, which will be hereinafter described.

The scan driver 210 is electrically connected to the plurality of scan lines 204 and configured to provide a plurality of scan signals. Each scan signal is characterized with a waveform having a compensation duration $T_C$ and a scan duration $T_S$ immediately following the compensation duration $T_C$, where the waveform in the compensation duration $T_C$ has a first voltage level and a second voltage level periodically and alternately varied from one another defining a period $\tau$, the waveform in the scan duration $T_S$ has the first voltage level, and the period $\tau$ is equal to the scan duration $T_S$ that is shorter than the compensation duration $T_C$, as shown in FIG. 1. The data driver 220 is electrically connected to the plurality of data lines 202 and configured to provide a plurality of data signals that is associated with an image to be displayed, as shown in FIG. 1. In operation, the scan driver 210 sequentially applies the plurality of scan signals to the plurality of scan lines 204, and the data driver 220 simultaneously applies the plurality of data signals to the plurality of data lines 202, respectively, such that during the compensation duration $T_C$ of a scan signal, the pixels 200 of a corresponding pixel row connected to the scan line to 204 which the scan signal is applied are charged for compensation of the OLED thereof, while during the scan duration $T_S$ of the scan signal, the plurality of data signals is written into the pixels 200 of the corresponding pixel row for driving the OLEDs thereof.

As shown in FIG. 2A, the pixel 200 has a 4T2C pixel circuit structure including four (4) transistors and two (2) capacitors. Specifically, the pixel 200 includes an OLED 208, a driving transistor Td, a first transistor T1, a second transistor T2, a third transistor T3, a storage capacitor Cs and a compensation capacitor Cp. Each of the driving transistor Td, the first transistor T1, the second transistor T2 and the third transistor T3 has a gate, a source and a drain. The source of the driving transistor Td is electrically coupled to the OLED 208. The gate of the first transistor T1 is electrically connected to the corresponding scan line 204, the drain of the first transistor T1 is electrically coupled to the corresponding data line 202, and the source of the first transistor T1 is electrically coupled to the gate of the driving transistor Td. The gate of the second transistor T2 is electrically coupled to an emission signal source, the drain of the second transistor T2 is electrically coupled to the corresponding power line 206, and the source of the second transistor T2 is electrically coupled to the drain of the driving transistor Td. The gate of the third transistor T3 is electrically coupled to a reset signal source, the drain of the third transistor T3 is electrically coupled to a low voltage source Vsus, and the source of the third transistor T3 is electrically coupled to the source of the driving transistor Td. The storage capacitor Cs is electrically coupled between the gate of the driving transistor Td and the source of the driving transistor Td, forming two nodes A and B on the two ends of storage capacitor Cs. The compensation capacitor Cp is electrically coupled between the drain of the second transistor T2 and the source of the driving transistor Td.

Figure 2B:
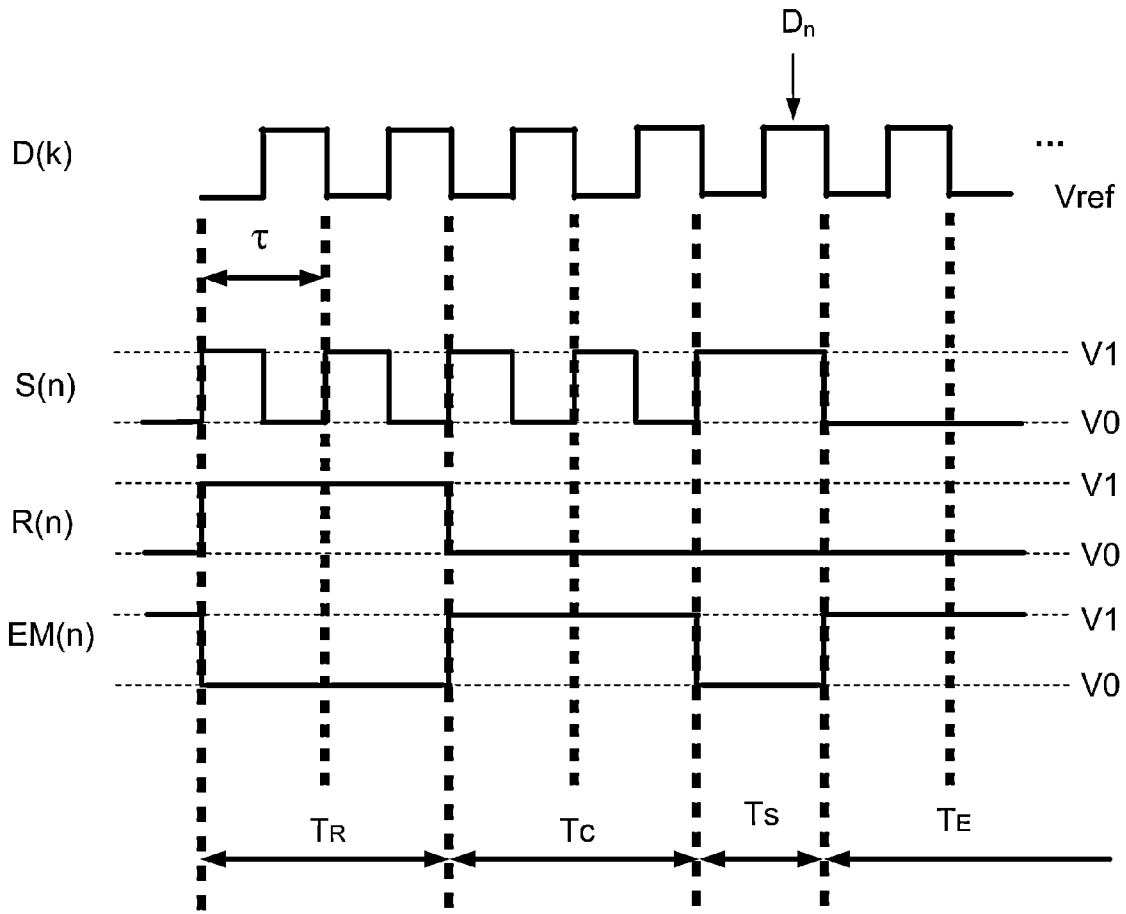
FIG. 2B shows schematically waveforms of driving signals for an OLED display shown in FIG. 2A according to one embodiment of the present invention.

Referring to FIG. 2B, waveforms of driving signals for an OLED display shown in FIG. 2A are illustrated according to one embodiment of the present invention. In this exemplary embodiment, a data signal is provided through the data line 202 to a pixel 200 in the n-th pixel row of the OLED display. The corresponding scan line 204 provides a corresponding scan signal S(n), the reset signal source provides a corresponding reset signal R(n), and the emission signal source provides a corresponding emission signal EM(n). The period defined by the scan signal S(n) is T. For better illustration purposes, each of the signals are shown to have the same high voltage level V1 or the same low voltage level V0.

The resetting step can be preformed by applying a reset signal to reset the pixels of the corresponding pixel row for a reset duration $T_R$ prior to the compensation duration $T_C$. The reset duration $T_R$ is longer than the scan duration Ts. Preferably, the reset duration $T_R$ is M times of the scan duration Ts, where M is a positive integer. In the exemplary embodiment shown in FIG. 2B, the reset duration $T_R$ is exactly two times of the scan duration Ts.

During the reset duration $T_R$, the reset signal R(n) has the high voltage level V1, and the emission signal EM(n) has the low voltage level V0. The scan signal S(n) is in the opposite phase to the data signal. Specifically, the scan signal S(n) has the high voltage level V1 and the low voltage level V0 periodically and alternately varied from one another within each period τ. Accordingly, the first transistor T1 is in an ON state for the first part within each period τ and in an OFF state for the second part within each period τ, the second transistor T2 is in an OFF state, and the third transistor T3 is in an ON state to reset the storage capacitor Cs to the pre-emission state, where the node A has the potential of Vref and the node B has a low potential of Vsus.

After resetting the pixel 200, compensation is performed to the pixel 200 for a compensation duration $T_C$, which is after the reset duration $T_R$ and prior to the scan duration Ts. The compensation duration $T_C$ is longer than the scan duration Ts. Preferably, the compensation duration $T_C$ is N times of the scan duration Ts, where N can be any positive integer. In the exemplary embodiment shown in FIG. 2B, the compensation duration $T_C$ is exactly two times of the scan duration Ts.

During the compensation duration $T_C$, the reset signal R(n) has the low voltage level V0, and the emission signal EM(n) has the high voltage level V1. The scan signal S(n) is in the opposite phase to the data signal. Specifically, the scan signal S(n) has the high voltage level V1 and the low voltage level V0 periodically and alternately varied from one another within each period τ. Accordingly, the second transistor T2 is turned ON and the third transistor T3 is turned OFF such that the node A would maintain the potential of Vref, and the node B would increase to a potential of Vref-Vth to charge the pixel 200, where Vth is the threshold voltage of the driving transistor Td. Since the compensation duration $T_C$ takes multiple scan periods, there is sufficient time for the complete compensation procedure.

After the compensation procedure, the data D(n) is written into the pixel 200 during the scan duration Ts.

During the scan duration Ts, both the reset signal R(n) and the emission signal EM(n) have the low voltage level V0. The scan signal S(n) has the high voltage level V1 for the whole scan duration Ts. Accordingly, the first transistor T1 is turned ON, and both the second and third transistors T2 and T3 are turned OFF, such that the node A would have the potential Vdata and the node B would increase to a potential of Vref−Vth+a(Vdata−Vref), where Vdata is the voltage of the data segment D(n), and a is the capacitance ratio of Cs/(Cs+Cp). Thus, the data D(n) is written into the pixel 200.

After the writing procedure, an emission procedure is performed by applying an emission signal EM(n) to the pixel 200 for an emission duration $T_E$ immediately following the scan duration $T_S$ such that the OLED 208 is driven to emit light according to the data signal D(n) written into the pixel 200.

During the emission duration $T_E$, both the scan signal S(n) and the reset signal R(n) have the low voltage level V0, and the emission signal EM(n) has the high voltage level V1. Accordingly, the first and third transistors T1 and T3 are turned OFF, and the second transistor T2 is turned ON. Accordingly, the node A would increase to the potential of (1−a)(Vdata−Vref)+Vss+VOLED+Vth, where VOLED is the voltage of the OLED 208, and the node B would increase to the potential of Vss+VOLED, resulting in a potential difference Vgs of the storage capacitor Cs. The driving transistor Td would thus be turned on for driving the OLED 208 to emit light. The potential difference Vgs is:

$$Vgs=(1-a)(V\text{data}-V\text{ref})+V\text{th}.$$

Figure 2C:
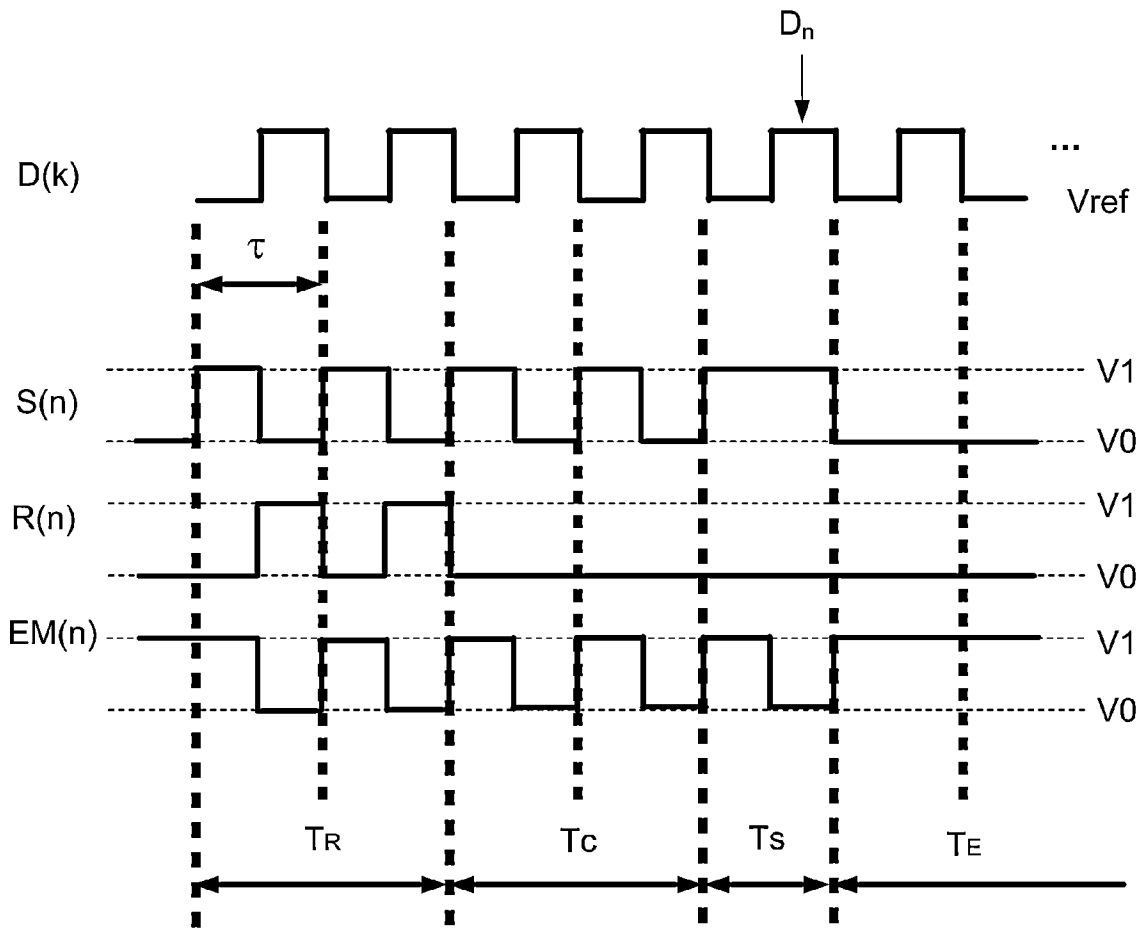
FIG. 2C shows schematically waveforms of driving signals for an OLED display shown in FIG. 2A according to another embodiment of the present invention.

FIG. 2C shows schematically waveforms of driving signals for an OLED display shown in FIG. 2A according to another embodiment of the present invention. In this embodiment, both the reset signal R(n) and the emission signal EM(n) are also designed to correspond to the data signal in the same waveform format of the scan signal S(n). In other words, during the reset duration $T_R$, the reset signal R(n) is in the same phase as the data signal, which has the low voltage level V0 and the high voltage level V1 periodically and alternately varied from one another within each period τ. During the reset duration $T_R$, the compensation duration $T_C$ and the scan duration $T_S$, the emission signal EM(n) is in the opposite phase to the data signal, which has the high voltage level V1 and the low voltage level V0 periodically and alternately varied from one another within each period τ. The scan signal S(n) has the same waveform as the scan signal S(n) shown in FIG. 2B. Details of the method shown in FIG. 2C are the same as the method shown in FIG. 2B, and are hereinafter omitted.

It should be appreciated that, in some embodiments, the signals have the low voltage level V0 and the high voltage level V1 periodically and alternately varied from one another within each period τ. As shown in FIG. 2C, each of the low voltage level V0 and the high voltage level V1 occupies half of the period τ. However, the duration ratio of the low voltage level V0 and the high voltage level V1 can be arranged according to the requirements of the driving circuits.

Figure 2D:
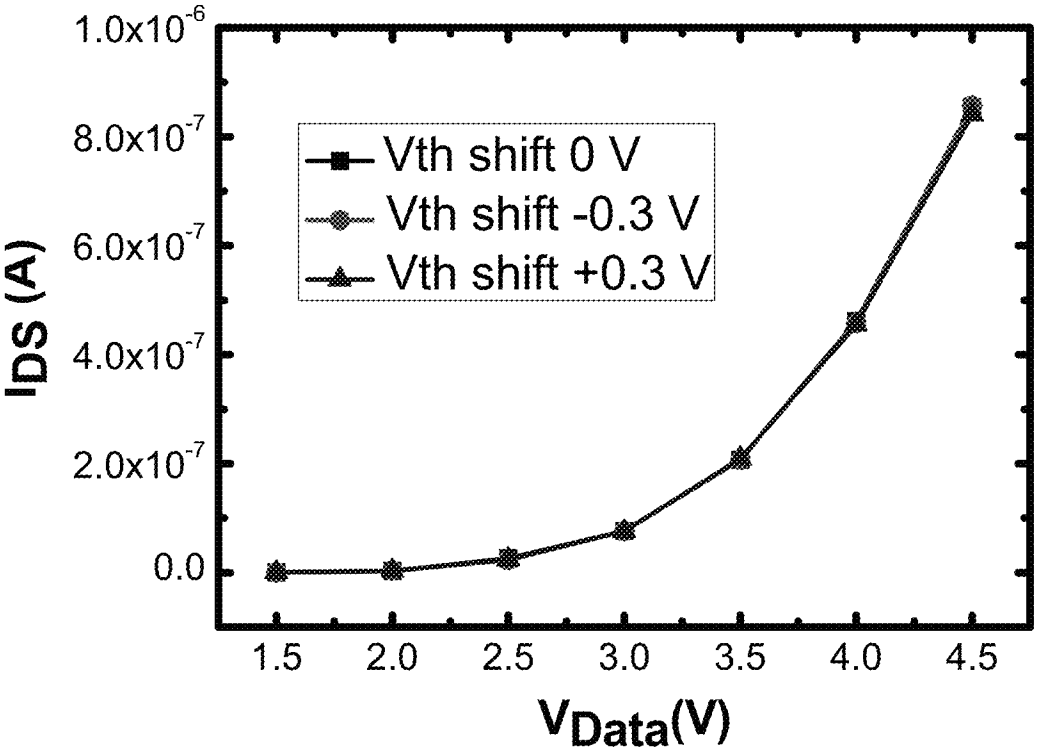
FIG. 2D shows a chart of the voltage shift performance of the OLED display of FIG. 2A according to one embodiment of the present invention.

FIG. 2D shows a chart of the voltage shift performance of the OLED display 20 shown in FIG. 2A. In this embodiment, the output current $I_{DS}$ of the pixel is:

$$I_{DS}=k[(1-a)(V\text{data}-V\text{ref})]^2.$$

As shown in FIG. 2D, regardless of the shift of the threshold voltage Vth of the driving transistor Td, the Vdata−$I_{DS}$ curves are essentially the same. In other words, the method of driving the OLED display provides sufficient time for compensation charging to obtain a stable output current $I_{DS}$ of the OLED display.

It should be noted that the 4T2C pixel circuit structure as shown in FIG. 2A can be implemented in a variety of different ways, with different signals being provided to perform the method of multi-scan compensation.

Figure 3A:
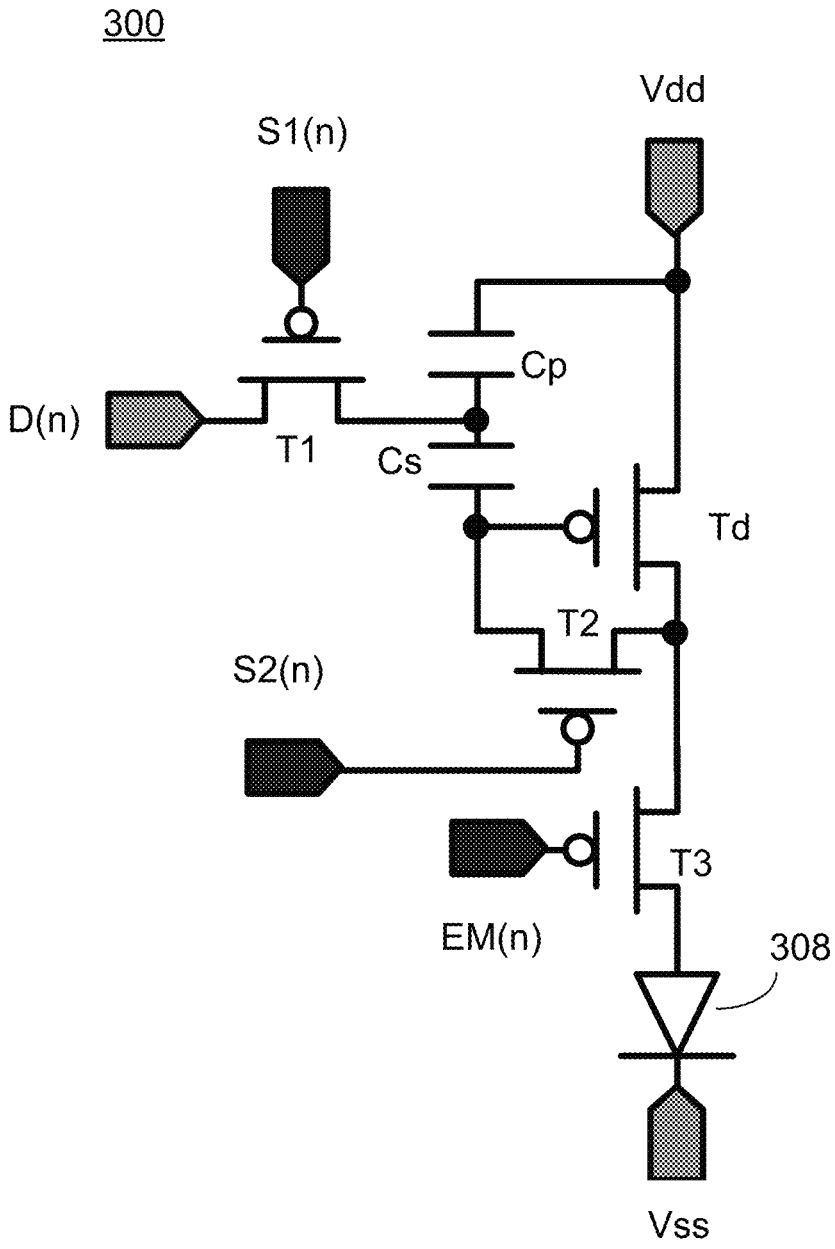
FIG. 3A shows schematically a pixel of an OLED display according to one embodiment of the present invention.

FIG. 3A shows schematically a pixel of an OLED display according to one embodiment of the present invention. For better illustration purposes, FIG. 3A shows only the pixel circuit of the pixel 300, and does not show other elements of the OLED display, such as the data line, the scan line and the power line.

As shown in FIG. 3A, the pixel 300 includes an organic light emitting diode (OLED) 308, a driving transistor Td, a first transistor T1, a second transistor T2, a third transistor T3, a storage capacitor Cs and a compensation capacitor Cp. In other words, the pixel 300 also has a 4T2C pixel circuit structure, but with a different circuitry from the pixel 200 of FIG. 2A.

Each of the driving transistor Td, the first transistor T1, the second transistor T2 and the third transistor T3 has a gate, a source and a drain. The source of the driving transistor Td is electrically coupled to the corresponding power line Vdd. The gate of the first transistor T1 is electrically coupled to a corresponding first scan line S1(*n*), and the source of the first transistor T1 is electrically coupled to the corresponding data line D(n). The gate of the second transistor T2 is electrically coupled to a corresponding second scan line S2(*n*), the source of the second transistor T2 is electrically coupled to the drain of the driving transistor Td, and the drain of the second transistor T2 is electrically coupled to the gate of the driving transistor Td. The gate of the third transistor T3 is electrically coupled to an emission signal source EM(n), the source of the third transistor T3 is electrically coupled to the drain of the driving transistor Td, and the drain of the third transistor T3 is electrically coupled to the OLED 308.

The storage capacitor Cs is electrically coupled between the gate of the driving transistor Td and the drain of the first transistor T1. The compensation capacitor Cp is electrically coupled between the power line Vdd and the drain of the first transistor T1.

Figure 3B:
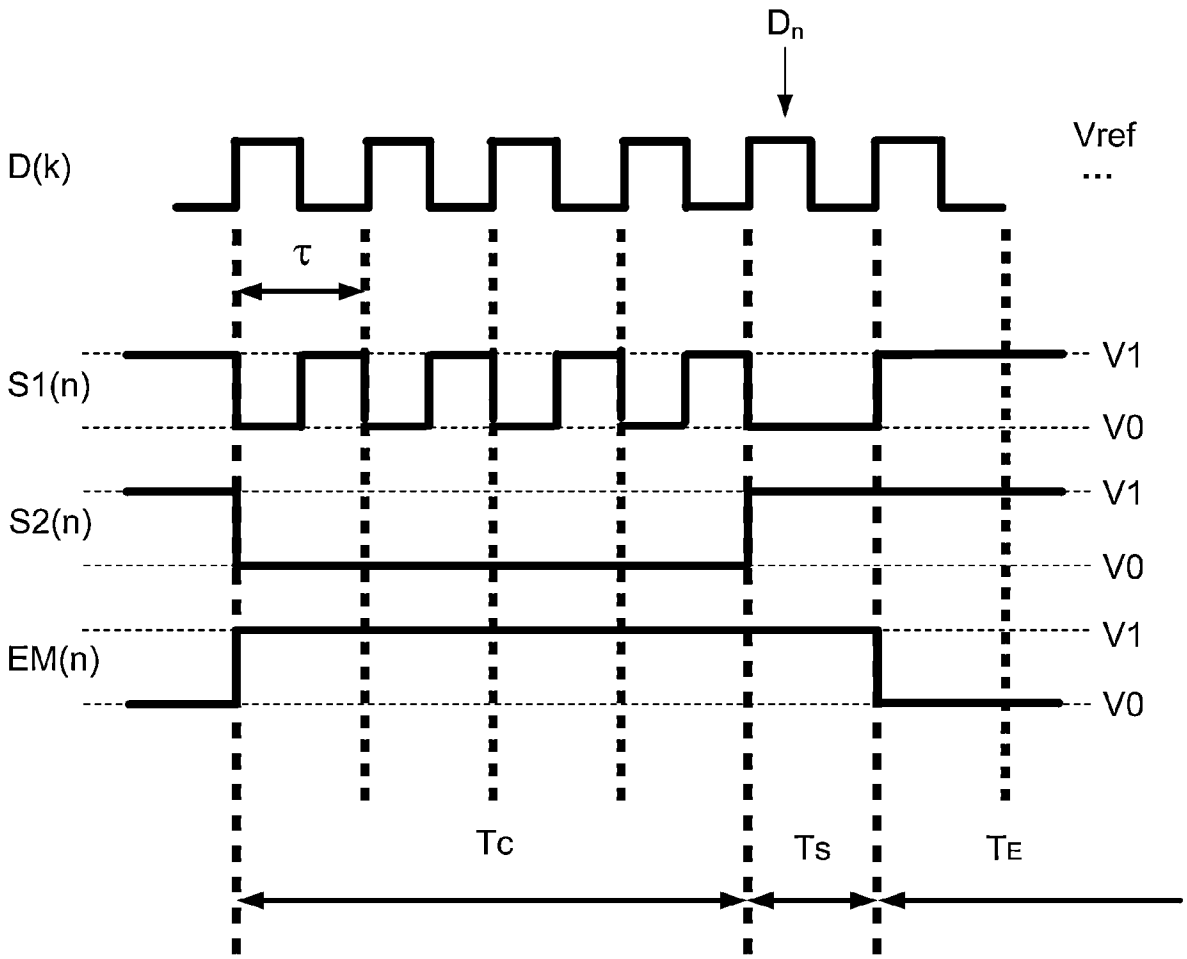
FIG. 3B shows schematically waveforms of driving signals for an OLED display shown in FIG. 3A according to one embodiment of the present invention.

Referring to FIG. 3B, waveforms of driving signals for an OLED display shown in FIG. 3A are illustrated according to one embodiment of the present invention. In the exemplary embodiment, the corresponding first scan signal S1(*n*) is provided to the n-th pixel row, a data signal is provided to the pixel 300 in the n-th pixel row of the OLED display, in which the data $D_n$ is to be written to the pixel 300. The second scan signal S2(*n*) and the corresponding emission signal EM(n) are also provided to the pixel 300, and there is no reset signal. The period defined by the scan signal S(n) is τ. For better illustration purposes, each of the signals are shown to have the same high voltage level V1 or the same low voltage level V0.

As shown in FIG. 3B, before the data D(n) is written to the pixel 300, compensation is performed to the pixel 300 for a compensation duration $T_C$, which is prior to the scan duration Ts. The compensation duration $T_C$ is longer than the scan duration Ts. Preferably, the compensation duration $T_C$ is N times of the scan duration Ts, where N can be any positive integer. In the embodiment shown in FIG. 3B, the compensation duration $T_C$ is exactly four times of the scan duration Ts.

During the compensation duration $T_C$, the second scan signal S2(*n*) has the low voltage level V0, and the emission signal EM(n) has the high voltage level V1. The first scan signal S(n) is in a phase opposite to that of the data signal. Specifically, the scan signal S(n) has the low voltage level V0 and the high voltage level V1 periodically and alternately varied from one another within each period τ. Accordingly, the second transistor T2 is turned ON and the third transistor T3 is turned OFF, and the first transistor T1 is turned ON to charge the pixel 300. In other words, the first scan signal S1(*n*) serves as the compensation signal. Since the compensation duration $T_C$ takes multiple scan periods τ, there is sufficient time for the complete compensation procedure.

After the compensation procedure, the data D(n) is written into the pixel 300 during the scan duration Ts.

During the scan duration Ts, the first scan signal S1(*n*) has the low voltage level V0, and the emission signal EM(n) have the high voltage level V1. The second scan signal S2(*n*) has the high voltage level V1 for the whole scan duration Ts. Thus, as shown in FIG. 3A, the first transistor T1 is turned ON, and both the second and third transistors T2 and T3 are turned OFF, such that the data D(n) is written in the pixel 300.

After the writing procedure, an emission procedure is performed by applying an emission signal EM(n) to the pixel 300 for an emission duration $T_E$ immediately following the scan duration $T_S$ such that the OLED 308 is driven to emit light according to the data signal D(n) written into the pixel 300.

During the emission duration $T_E$, both the first and second scan signals S1(*n*) and S2(*n*) have the high voltage level V1, and the emission signal EM(n) has the low voltage level V0. Accordingly, the first and second transistors T1 and T2 are turned OFF, and the third transistor T3 is turned ON. Accordingly, the OLED 308 is driven to emit light.

Figure 4A:
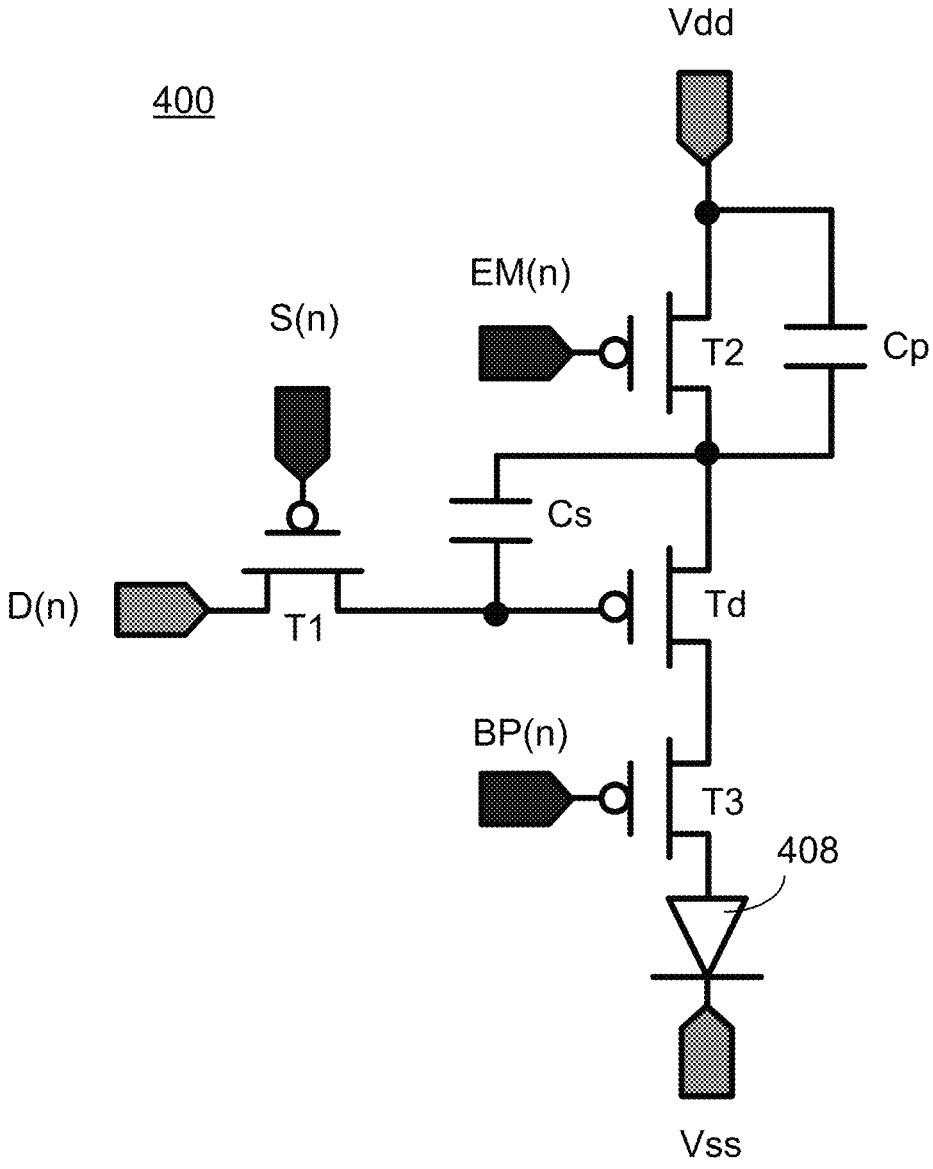
FIG. 4A shows schematically a pixel circuit of an OLED display according to one embodiment of the present invention.

Referring now to FIG. 4A, a pixel of an OLED display is schematically shown according to one embodiment of the present invention. For better illustration purposes, FIG. 4A shows only the pixel circuit of the pixel 400, and does not show other elements of the OLED display, such as the data line, the scan line and the power line.

As shown in FIG. 4A, the pixel circuit 400 includes an organic light emitting diode (OLED) 408, a driving transistor Td, a first transistor T1, a second transistor T2, a third transistor T3, a storage capacitor Cs and a compensation capacitor Cp. In other words, the pixel circuit 400 also has a 4T2C pixel circuit structure, but with a different circuitry from the pixel 200 of FIG. 2A or the pixel 300 of FIG. 3A.

Each of the driving transistor Td, the first transistor T1, the second transistor T2 and the third transistor T3 has a gate, a source and a drain. The gate of the first transistor T1 is electrically coupled to the scan line S(n), the source of the first transistor T1 is electrically coupled to the data line D(n), and the drain of the first transistor T1 is electrically coupled to the gate of the driving transistor Td. The gate of the second transistor T2 is electrically coupled to an emission signal source EM(n), the source of the second transistor T2 is electrically coupled to the power line Vdd, and the drain of the second transistor T2 is electrically coupled to the source of the driving transistor Td. The gate of the third transistor T3 is electrically coupled to a bypass control signal source BP(n), the source of the third transistor T3 is electrically coupled to the drain of the driving transistor Td, and the drain of the third transistor T3 is electrically coupled to the OLED 408.

The storage capacitor Cs is electrically coupled between the gate of the driving transistor Td and the source of the driving transistor Td. The compensation capacitor Cp is electrically coupled between the power line Vdd and the drain of the second transistor T2.

Figure 4B:
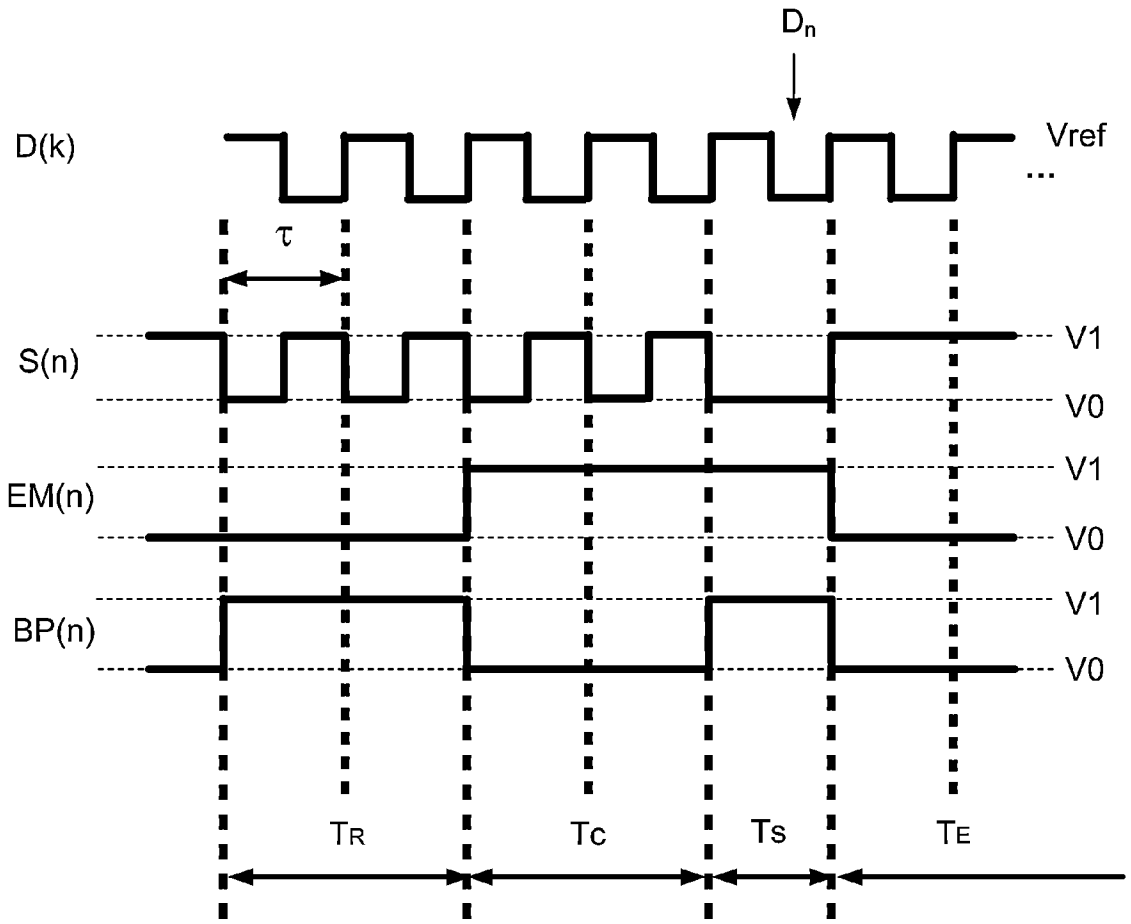
FIG. 4B shows schematically waveforms of driving signals for an OLED display shown in FIG. 4A according to one embodiment of the present invention.
Figure 5:
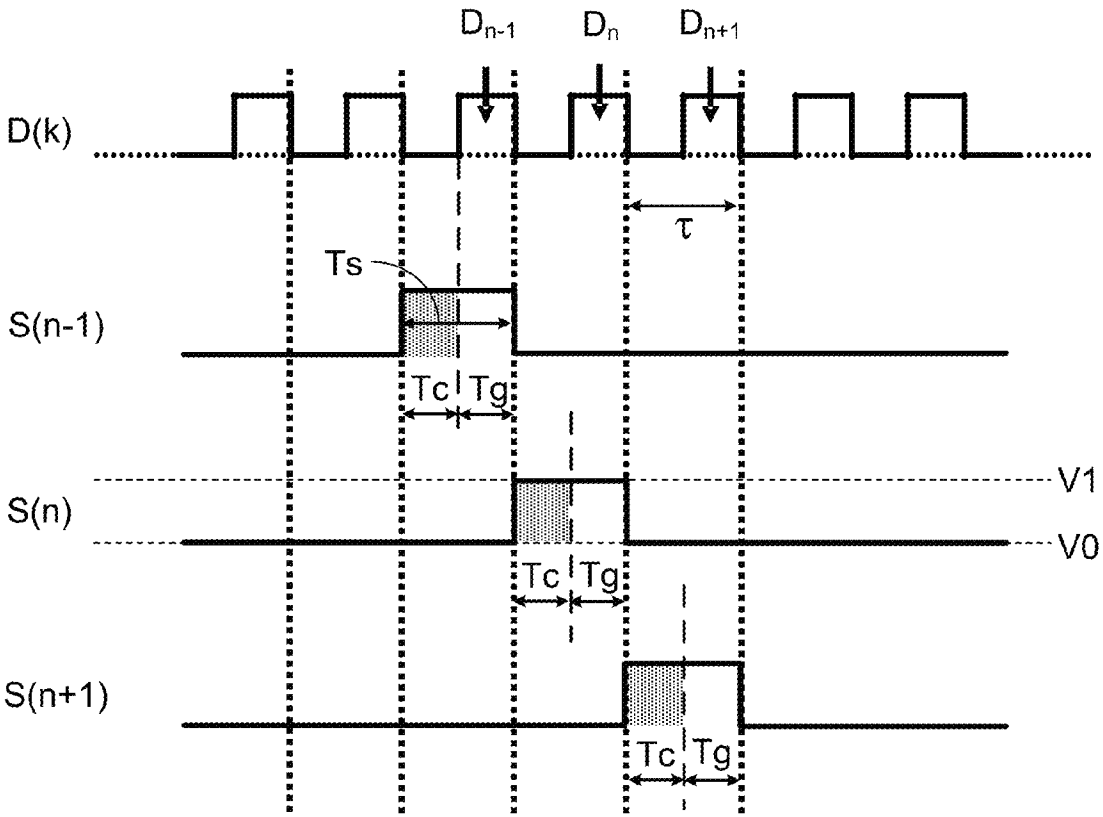
FIG. 5 (Related Art)
FIG. 5 shows schematically waveforms of driving signals for a conventional OLED display.

FIG. 4B shows schematically waveforms of driving signals for an OLED display shown in FIG. 4A according to one embodiment of the present invention. In this embodiment, a scan signal S(n) is also applied to the n-th pixel row, and a data signal is provided to the pixel 400 in the n-th pixel row of the OLED display. The emission signal EM(n) and a bypass control signal BP(n) are also provided. The period defined by the scan signal S(n) is T. For better illustration purposes, each of the signals are shown to have the same high voltage level V1 or the same low voltage level V0. Further, as shown in FIG. 4B, the reference voltage Vref of the data signal is higher than the data voltage Vdata.

As shown in FIG. 4B, a resetting step is preformed by applying a reset signal to reset the pixels of the corresponding pixel row for a reset duration $T_R$ prior to the compensation duration $T_C$. The reset duration $T_R$ is longer than the scan duration Ts. In one embodiment, the reset duration $T_R$ is M times of the scan duration Ts, where M is a positive integer. In the exemplar embodiment shown in FIG. 4B, the reset duration $T_R$ is exactly two times of the scan duration Ts.

During the reset duration $T_R$, the bypass control signal BP(n) has the high voltage level V1, and the emission signal EM(n) has the low voltage level V0. The scan signal S(n) is in the opposite phase to the data signal. Specifically, the scan signal S(n) has the low voltage level V0 and the high voltage level V1 periodically and alternately varied from one another within each period τ. Accordingly, the second transistor T2 is in an ON state and the third transistor T3 is in an OFF state, and the first transistor T1 is turned ON at the time both the scan signal S(n) and the data signal are provided with the high voltage level V1 to reset the storage capacitor Cs to the pre-emission state. In other words, the bypass control signal BP(n) serves as a reset signal during the reset duration $T_R$.

After the bypass control of the pixel 400, compensation is performed to the pixel 400 for a compensation duration $T_C$, which is after the reset duration $T_R$ and prior to the scan duration Ts. The compensation duration $T_C$ is longer than the scan duration Ts. In one embodiment, the compensation duration $T_C$ is N times of the scan duration Ts, where N can be any positive integer. In the exemplar embodiment shown in FIG. 4B, the compensation duration $T_C$ is exactly two times of the scan duration Ts.

During the compensation duration $T_C$, the bypass control signal BP(n) has the low voltage level V0, and the emission signal EM(n) has the high voltage level V1. The scan signal S(n) is in the opposite phase to the data signal. Specifically, the scan signal S(n) has the low voltage level V0 and the high voltage level V1 periodically and alternately varied from one another within each period τ. Accordingly, the second transistor T2 is turned OFF and the third transistor T3 is turned ON, and the first transistor T1 is turned ON at the time both the scan signal S(n) and the data signal are provided with the high voltage level V1 to charge the pixel 300. Since the compensation duration $T_C$ takes multiple scan periods τ, there is sufficient time for the complete compensation procedure.

After the compensation procedure, the data D(n) is written into the pixel 400 during the scan duration Ts.

During the scan duration Ts, the scan signal S(n) has the low voltage level V0, and both the bypass control signal BP(n) and the emission signal EM(n) have the high voltage level V1. Accordingly, the first transistor T1 is turned ON, and both the second and third transistors T2 and T3 are turned OFF, such that the data D(n) is written in the pixel 400.

After the writing procedure, an emission procedure is performed by applying an emission signal EM(n) to the pixel 400 for an emission duration $T_E$ immediately following the scan duration $T_S$ such that the OLED 408 is driven to emit light according to the data signal D(n) written into the pixel 400.

During the emission duration $T_E$, the scan signal S(n) has the high voltage level V1, and both the control signal BP(n) and the emission signal EM(n) have the low voltage level V0. Accordingly, the first transistor T1 is turned OFF, and the second and third transistors T2 and T3 are turned ON. Accordingly, the OLED 408 is driven to emit light.

In sum, the invention, among other things, recites an OLED display that utilizes multi-scanning for compensation and methods of driving the same. Compensation is performed to the pixel for a compensation duration prior to the scan duration, where the compensation duration is longer than the scan duration.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An organic light emitting diode (OLED) display, comprising:

a plurality of scan lines and a plurality of data lines crossing over the plurality of scan lines to define a plurality of pixels in a matrix form, each pixel electrically connected to a corresponding scan line and a corresponding data line and having an OLED;

a scan driver electrically connected to the plurality of scan lines and configured to provide a plurality of scan signals, wherein each scan signal is characterized with a waveform having a compensation duration and a scan duration immediately following the compensation duration, wherein the waveform in the compensation duration has a first voltage level and a second voltage level periodically and alternate varied from one another defining a period, and the waveform in the scan duration has the first voltage level, wherein the period is equal to the scan duration that is shorter than the compensation duration; and a data driver electrically connected to the plurality of data lines and configured to provide a plurality of data signals associated with an image to be displayed; and wherein in operation, the scan driver sequentially applies the plurality of scan signals to the plurality of scan lines and the data driver simultaneously applies the plurality of data signals to the plurality of data lines, respectively, such that during the compensation duration of a scan signal, the pixels of a corresponding pixel row connected to the scan line to which the scan signal is applied are charged for compensation, while during the scan duration of the scan signal, the plurality of data signals is written into the pixels of the corresponding pixel row for driving the OLEDs thereof, wherein each pixel further comprises:

a driving transistor having a gate, a source electrically coupled to the OLED, and a drain;

a first transistor having a gate electrically connected to the corresponding scan line to the pixel, a source electrically coupled to the gate of the driving transistor, and a drain electrically coupled to the corresponding data line to the pixel;

a second transistor having a gate, a source electrically coupled to the drain of the driving transistor, and a drain electrically coupled to a corresponding power line;

a third transistor having a gate, a source electrically coupled to the source of the driving transistor, and a drain electrically coupled to a low voltage source;

a storage capacitor electrically coupled between the gate of the driving transistor and the source of the driving transistor; and a compensation capacitor electrically coupled between the drain of the second transistor and the source of the driving transistor.

2. The OLED display of claim 1, wherein the compensation duration is N times of the scan duration, wherein N is a positive integer.

3. The OLED display of claim 1, wherein the first voltage level is a low voltage level, and the second voltage level is a high voltage level.

4. The OLED display of claim 1, wherein the first voltage level is a high voltage level, and the second voltage level is a low voltage level.

5. The OLED display of claim 1, wherein a reset signal is applied to the gate of the third transistor for a reset duration prior to the compensation duration.

6. The OLED display of claim 5, wherein the reset duration is M times of the scan duration, wherein M is a positive integer.

7. An organic light emitting diode (OLED) display, comprising:

a plurality of scan lines and a plurality of data lines crossing over the plurality of scan lines to define a plurality of pixels in a matrix form, each pixel electrically connected to a corresponding scan line and a corresponding data line and having an OLED;

a scan driver electrically connected to the plurality of scan lines and configured to provide a plurality of scan signals, wherein each scan signal is characterized with a waveform having a compensation duration and a scan duration immediately following the compensation duration, wherein the waveform in the compensation duration has a first voltage level and a second voltage level periodically and alternately varied from one another defining a period, and the waveform in the scan duration has the first voltage level, wherein the period is equal to the scan duration that is shorter than the compensation duration; and a data driver electrically connected to the plurality of data lines and configured to provide a plurality of data signals associated with an image to be displayed; and wherein in operation, the scan driver sequentially applies the plurality of scan signals to the plurality of scan lines and the data driver simultaneously applies the plurality of data signals to the plurality of data lines, respectively, such that during the compensation duration of a scan signal, the pixels of a corresponding pixel row connected to the scan line to which the scan signal is applied are charged for compensation, while during the scan duration of the scan signal, the plurality of data signals is written into the pixels of the corresponding pixel row for driving the OLEDs thereof, wherein each pixel further comprises:

a driving transistor having a gate, a source and a drain;

a first transistor having a gate electrically connected to the corresponding scan line to the pixel, a source electrically coupled to the corresponding data line to the pixel, and a drain electrically coupled to the gate of the driving transistor;

a second transistor having a gate, a source electrically coupled to a corresponding power line, and a drain electrically coupled to the source of the driving transistor;

a third transistor having a gate, a source electrically coupled to the drain of the driving transistor, and a drain electrically coupled to the OLED;

a storage capacitor electrically coupled between the gate of the driving transistor and the source of the driving transistor; and a compensation capacitor electrically coupled between the corresponding power line and the drain of the second transistor.

8. The OLED display of claim 7, wherein a reset signal is applied to the gate of the third transistor for a reset duration prior to the compensation duration.

9. The OLED display of claim 8, wherein the reset duration is M times of the scan duration, wherein M is a positive integer.

* * * * *